United States Patent [19]

Wasson

[11] 4,426,238

[45] Jan. 17, 1984

[54] BLASTING COMPOSITION CONTAINING PARTICULATE OXIDIZER SALTS

[75] Inventor: Daniel A. Wasson, Sandy, Utah

[73] Assignee: IRECO Chemicals, Salt Lake City, Utah

[21] Appl. No.: 75,577

[22] Filed: Sep. 14, 1979

[51] Int. Cl.[3] ..... C06B 31/30

[52] U.S. Cl. ..... 149/60; 149/2; 149/61; 149/76; 149/83

[58] Field of Search ..... 149/2, 2 F, 60, 61, 149/76, 83

[56] References Cited

U.S. PATENT DOCUMENTS

| | | | |
|---|---|---|---|
| 3,282,753 | 11/1966 | Cook et al. | 149/60 |
| 3,288,661 | 11/1966 | Swisstack | 149/60 |
| 3,397,097 | 8/1968 | Atadan et al. | 149/60 |
| 3,459,608 | 8/1969 | Ludolphy et al. | 149/60 |
| 4,055,449 | 10/1977 | Wasson | 149/2 |
| 4,104,092 | 8/1978 | Mullay | 149/2 |

OTHER PUBLICATIONS

"McCutcheon's Detergents & Emulsifiers", 1973 North American Edition, pp. 99, 100, 129, 154, 167–168, 173–175, & 185, Allured Publ. Corp., (1973), Ridgewood, N.J.

*Primary Examiner*—Edward A. Miller

[57] ABSTRACT

The invention relates to an aqueous explosive blasting composition having a continuous aqueous phase and comprising inorganic oxidizer salt of which at least a significant proportion is an undissolved, solid particulate form; a solution of oxidizer salt in water, immiscible liquid organic fuel finally and stably dispersed throughout the aqueous phase; thickener; a crystal habit modifier; and a non-ionic surfactant to retard desensitization of the composition that would otherwise occur due to the presence of the oxidizer salt particles.

7 Claims, No Drawings

BLASTING COMPOSITION CONTAINING PARTICULATE OXIDIZER SALTS

The present invention relates to improved explosive compositions of the aqueous gel or slurry type (hereafter referred to as "aqueous blasting compositions") and to an improved method of sensitizing such compositions. More particularly, the invention relates to an aqueous explosive blasting composition having a continuous aqueous phase and comprising inorganic oxidizer salt of which at least a significant proportion is in undissolved, solid particulate form; a solution of oxidizer salt in water, immiscible liquid organic fuel finely and stably dispersed throughout the aqueous phase; thickener; a crystal habit modifier; and a nonionic surfactant to retard desensitization of the composition that would otherwise occur due to the presence of the oxidizer salt particles. Without the addition of a nonionic surfactant, the compositions are found to lose their sensitivity with time. The method of sensitizing the composition relates to the addition of a nonionic surfactant to the composition.

BACKGROUND OF THE INVENTION

Explosives or blasting compositions of the aqueous gel or slurry type, commonly referred to as slurry explosives or blasting agents, and referred to herein as aqueous blasting compositions, have achieved wide acceptance as commercial blasting agents owing to their low cost, safety, physical properties and inherent water resistance. Such aqueous blasting compositions generally contain a continuous liquid phase, an inorganic oxidizing salt(s), usually predominately ammonium nitrate (AN), a thickening agent for the liquid phase in which some or all of the oxidizing salt is dissolved, a fuel and/or sensitizer and, optionally, other ingredients such as gassing and cross-linking agents. Of these ingredients, generally the fuel and/or sensitizer has the highest ingredient cost. Fine aluminum particles commonly are employed as both fuel and sensitizer in aqueous blasting compositions. Other fuels find substantial use as well, for example, liquid organic fuels, sulfur, carbonaceous materials, and others. Aluminum and certain other fuels or combinations thereof are relatively expensive, however.

U.S. Pat. No. 4,055,449 discloses the use of a relatively inexpensive immiscible liquid organic fuel which can be effectively dispersed throughout an aqueous blasting composition having a continuous aqueous phase and which dispersion can be stably maintained throughout the continuous phase by the use of a crystal habit modifier. That patent discloses that a crystal habit modifier will prevent loss of sensitivity that would otherwise occur due to the segregation or separation of oxidizer and fuel resulting from the coalescence of dispersed immiscible liquid fuel droplets. The crystal habit modifier induces the formation of a crystal matrix which prevents migration and coalescence of the liquid fuel droplets.

It has been found that some desensitization with time will occur in an aqueous blasting composition containing a continuous aqueous phase and an immiscible liquid organic fuel even in the presence of a crystal habit modifier, if a significant proportion of AN or other inorganic oxidizer salt is present in an undissolved, particulate form such as prills. This phenomenon is described in column 4 of U.S. Pat. No. 4,055,449. The crystal habit modifier functions well in controlling the crystal size of oxidizer salt crystals which may precipitate out of solution upon cooling of a composition from its elevated formulation temperature. However, the modifier cannot by itself effectively act on prills or particles that are not dissolved during formulation of the composition. And it is found that the presence of AN in large particle sizes such as prill form causes a loss of sensitivity with time. It has been found in the present invention that the addition of a nonionic surfactant to a composition containing a continuous aqueous, an immiscible liquid organic fuel dispersed throughout such phase, and a crystal habit modifier will retard desensitization that would otherwise occur due to the presence of the inorganic oxidizer salt particles.

SUMMARY OF THE INVENTION

The aqueous blasting composition of the invention comprises inorganic oxidizer salt in particulate form, a solution of oxidizer salt in water forming a continuous aqueous phase, an immiscible liquid organic fuel finely dispersed throughout the aqueous phase, a thickener, a crystal habit modifier, and a nonionic surfactant to retard desensitization of the composition that would otherwise occur due to the presence of the oxidizer salt particles. Preferably, the nonionic surfactant is hydrophilic in character and is selected from the group consisting of nonylphenol ethoxylates and linear ethoxylated alcohols having from about 11 carbon atoms to about 20 carbon atoms and is present in an amount of from a trace to about 1% or more by weight, based on the total composition. The method of the present invention comprises a method for retarding desensitization of an aqueous blasting composition comprising inorganic oxidizer salt in particulate form, a solution of oxidizer salt in water forming a continuous aqueous phase, an immiscible liquid organic fuel finely dispersed throughout the aqueous phase, thickener, and a crystal habit modifier, by adding a nonionic surfactant to retard desensitization of the composition that would otherwise occur due to the presence of the oxidizer salt particles.

DETAILED DESCRIPTION OF THE INVENTION

The compositions of the present invention generally are formulated by first forming a solution of the oxidizer salt and water at a temperature above the crystallization temperature of the salt in solution (generally about 20° C. or higher). This solution is maintained at an elevated temperature of about 10° C. above its crystallization temperature. The remaining ingredients are then added, viz., crystal habit modifier, thickener, oxidizer salt particles (generally but not necessarily in prill form), immiscible inorganic fuel, and nonionic surfactant. Preferably, the solution containing the crystal habit modifier and other ingredients is pre-thickened with the thickener prior to the addition of the liquid fuel. The resulting mixture is stirred by mechanical means as is well-known in the art until the composition is uniform and the liquid organic fuel is uniformly dispersed throughout the solution that forms a continuous aqueous phase. Upon cooling of the newly-formulated composition, the oxidizer salt will begin to precipitate from the solution at temperatures of crystallization or below. The crystal habit modifier will limit and modify the particle size and shape of these crystals and such modification will help to stabilize the dispersion of immiscible organic fuel droplets throughout the aqueous phase. The nonionic surfactant stabilizes the modified crystalline structure and thus stabilizes the resulting sensitivity of the composition, which sensitivity otherwise would be affected adversely by the presence of the oxidizer salt particles.

The nonionic surfactant preferably is selected from the group consisting of nonylphenol ethoxylates and linear ethoxylated alcohol having from about 11 carbon atoms to about 20 carbon atoms, and each of these types of surfactants have a "Hydrophile-Lipophile Balance" (HLB) of from about 12 to about 17. The HLB value comes from a scheme developed by ICI United States Inc. in the 1940's. The HLB of a surfactant is an expression of its balance of the size and strength of the hydrophilic and the lipophilic groups of the surfactant. All surfactants contain both hydrophilic and lipophilic groups. A surfactant that is lipophilic in character is assigned a low HLB number (below 9.0) and one that is hydrophilic is assigned a high HLB number (above 11.0). Those in the range 9–11 are intermediate. The HLB of a surfactant is related to its solubility. A surfactant having a low HLB will tend to be oil-soluble, and one having a high HLB will tend to be water-soluble. Preferably, the HLB of the surfactants of the present invention is about 15. The nonionic surfactant preferably is present in amounts of from a trace to about 1% or more by weight, based on the total composition, although the upper limit is one of practicality not necessity. The nonionic surfactant is present more preferably in an amount of from about 0.05% to about 0.5%.

It is not fully understood how the nonionic surfactant functions to retard desensitization of the aqueous blasting compositions of present invention. When a crystal habit modifier is used in the presence of AN prills, for example, and in the absence of a nonionic surfactant, the diameter of the prills increase, and the prills develop a glassy appearance. It was thought that if the prills could be prevented from growing, the sensitivity of the composition could be retained. However, a clear correlation between prill size and desensitization was not found. Nevertheless desensitization was found to occur in the presence of AN prills. Thus it is thought that in addition to the mechanism for prill growth, there is a recrystallization or a reformation of the crystals in the prill. This is suggested from the glassy appearance. It is found that the addition of a nonionic surfactant as a wetting agent modifies the reformation of the prill crystals such that appreciable desensitization does not occur. In effect, the nonionic surfactant allows the crystal habit modifier to work effectively on the prills so that they do not desensitize the composition.

The oxidizer salt or salts are selected from the group consisting of ammonium and alkali metal nitrates and perchlorates and alkaline earth metal nitrates and perchlorates. Preferably, the oxidizer salt is AN alone or in combination with sodium nitrate (SN). The amount of oxidizer salt employed is generally from about 50% to about 80% by weight of the total composition and preferably from about 60% to about 75%. At least about 5% of the oxidizer salt is in particulate form, with the remainder being initially dissolved in the water during formulation at an elevated temperature. Preferably, the composition contains at least about 10% by weight of salt particles. It is desirable from an energy standpoint to use salt particles because less water is needed and thereby the energy of the composition can be increased. Heretofore, however, the use of particles was limited because of their desensitizing effect.

The total amount of water present in the composition is generally from about 10 to about 35% by weight. The use of water in amounts within this range will generally allow the compositions to be fluid enough to be pumped by conventional slurry pumps at elevated formulation or mixing temperatures (above the fudge point of the composition). After pumping, precipatation of at least part of the dissolved oxidizer salt will occur upon cooling to temperatures below the crystallization temperature.

The immiscible liquid organic fuel preferably is present in amounts from about 1% to about 12% by weight. The actual amount used depends upon the particular immiscible fuel and supplemental fuels (if any) used. Preferably, the amount of fuel used is such to result in an overall oxygen balance of the composition of from −10 to 0 percent. Fuel oil, when used, is normally used in amounts of from about 1% to about 8% by weight, preferably from about 3% to about 7%, and when used as the sole fuel, is preferably used in amounts of from about 4% to about 6% by weight. The immiscible organic fuels can be aliphatic, alicyclic, and/or aromatic and either saturated and/or unsaturated. For example, toluene and the xylenes can be employed. Aliphatic and aromatic nitro-compounds also can be used. Preferred fuels include mixtures of normally liquid hydrocarbons generally referred to as petroleum distillates such as gasoline, kerosene and diesel fuels. A particularly preferred liquid fuel is No. 2 fuel oil. Tall oil and paraffin oil also can be used. Mixtures of any of the above fuels can be used.

Optionally, and in addition to the immiscible liquid organic fuel, solid or other liquid fuels or both can be employed in selected amounts. Examples of solid fuels which can be used are particulate aluminum, carbonaceous materials such as gilsonite or coal; vegetable grain such as wheat; etc. Miscible liquid fuels can include alcohols such as methyl alcohol, glycols such as ethylene glycol, amides such as formamide, and analagous nitrogen-containing liquids. These liquids generally act as a solvent for the oxidizer salt and, therefore, can replace water to varying degrees. Normally, when a stable, fine dispersion or the immiscible liquid organic fuel is obtained, as in the present invention, additional fuels in solid or liquid form are not necessary.

The aqueous fluid phase of the composition is rendered viscous by the addition of one or more thickening agents of the type and in the amount commonly employed in the art. Such thickening agents include galactomannin, preferably guar gums; guar gum of reduced molecular weight as described in U.S. Pat. No. 3,788,909, polyacrylamide and analogous synthetic thickeners, flours, and starches. Biopolymer gums, such as those described in U.S. Pat. No. 3,788,909 also can be used. Thickening agents generally are used in amounts ranging from about 0.05% to about 1.5% but flours and starches may be employed in much greater amounts, up to about 10% in which case they also function importantly as fuels. Mixtures of thickening agents can be used.

As is well-known in the art, gassing or density reducing agents are preferably employed to lower and control the density of and to impart sensitivity to aqueous blasting compositions. The compositions of the present invention preferably employ a small amount, e.g., about 0.01 to about 0.2% or more, of such gassing agent in order to obtain a composition density of less than about 1.3 gm/cc. A preferred gassing agent is a nitrite salt such as sodium nitrite, which decomposes chemically in the solution of the composition to produce gas bubbles. Thiourea is preferably employed to accelerate the decomposition of a nitrite gassing agent. Gas bubbles can also be entrained in the thickened aqueous phase of the composition during mixing. Hollow particles such as hollow spheres, styrofoam beads, perlite and plastic micro-balloons are also commonly employed as a means of supplying free space. Two or more of these common gassing means may be employed simultaneously.

Preferably the crystal habit modifiers are anionic surfactants, although cationic surfactants can be used. U.S. Pat. No. 3,397,097 lists modifiers of the type used in the present invention. A particularly preferred modifier is sodium methylnaphthalene sulfonate "Petro-AG.". Other modifiers are higher ($C_8$-$C_{18}$) alcohol sulfonic esters, e.g., sodium lauryl and sodium stearyl sulfate; aliphatic alcohol phosphates; aliphatic amide sulfonates; alkylaryl sulfonates and sodium dinaphthylmethane disulfonates. The crystal habit modifier preferable is present in the amount of from about 0.05 to about 3% by weight and more preferably in the amount of from 0.5 to about 2.0%. During formulation the modifier is added to the oxidizer salt solution at a temperature above the crystallization point of the salt or salts in solution, so that the modifier can control the salt crystal size upon precipitation. It is preferable but not necessary that the crystal habit modifier be added to the hot salt solution prior to the incorporation of other ingredients.

Cross-linking agents in combination with suitable cross-linkable thickening agents are preferably employed in order to further stabilize the fine dispersion or distribution of the droplets of liquid organic fuel, as well as to prevent the undesired escape or migration of gas bubbles, and thus to maintain the sensitivity of the composition to detonation. Cross-linking agents also are especially useful where the stability or integrity of the composition must be maintained in the presence of water-containing boreholes. Excellent cross-linking of guar gum can be obtained by using a small amount, e.g., about 0.05 to about 0.2% of an aqueous solution of sodium dichromate. Other cross-linking agents will be apparent to those skilled in the art.

In the following examples all compositions were prepared according to the preferred method of formulation described above.

Examples A, B and C illustrate the effectiveness of the use of a nonionic surfactant. Example A did not contain a nonionic surfactant and resultantly lost its sensitivity with time. Examples B and C contained different nonionic surfactants and retained their sensitivity with time.

Examples D-G contain varying relative amounts of crystal habit modifier and nonionic surfactant. Example E did not contain a nonionic surfactant and lost its sensitivity after one months storage, whereas the other examples which contained nonionic surfactants retained theirs. Example F shows good storage results with only 0.05% by weight nonionic surfactant.

Examples H-L contain different nonionic surfactants.

The compositions of the present invention are designed primarily for direct placement into a borehole or other receptacle for subsequent detonation. They readily can be formed on-site in a mobile production unit (such as a slurry pump truck) and pumped into a borehole. The compositions also can be packaged in various diameters by well-known procedures.

While the present invention has been described with reference to certain illustrative examples and preferred embodiments, various modifications will be apparent to those skilled in the art and any such modifications are intended to be within the scope of the invention as set forth in the appended claims.

TABLE

| Composition (parts by Weight) | A | B | C | D | E | F | G | H | I | J | K | L |
|---|---|---|---|---|---|---|---|---|---|---|---|---|
| Ammonium Nitrate (AN) | 58.7 | 58.7 | 58.7 | 60.1 | 60.1 | 60.1 | 60.1 | 59.0 | 59.0 | 59.0 | 59.0 | 59.0 |
| Water | 14.7 | 14.7 | 14.7 | 14.6 | 14.6 | 14.6 | 14.6 | 14.4 | 14.4 | 14.4 | 14.4 | 14.4 |
| Thiourea | 0.1 | 0.1 | 0.1 | 0.1 | 0.1 | 0.1 | 0.1 | 0.1 | 0.1 | 0.1 | 0.1 | 0.1 |
| Thickener (guar gum) | 0.35 | 0.35 | 0.35 | 0.35 | 0.35 | 0.35 | 0.35 | 0.44 | 0.44 | 0.44 | 0.44 | 0.44 |
| Crystal Habit Modifier | 0.10 | 0.10 | 0.10 | 0.25 | 1.0 | 1.0 | 1.0 | 1.0 | 1.0 | 1.0 | 1.0 | 1.0 |
| Nonionic Surfactant | 0 | 0.2[a] | 0.2[b] | 0.2[a] | 0 | 0.05[a] | 0.4[a] | 0.2[c] | 0.2[d] | 0.2[e] | 0.2[f] | 0.2[g] |
| Prilled AN | 20.0 | 20.0 | 20.0 | 20.0 | 20.0 | 20.0 | 20.0 | 20.0 | 20.0 | 20.0 | 20.0 | 20.0 |
| No. 2 Fuel Oil | 4.7 | 4.7 | 4.7 | 4.6 | 4.6 | 4.6 | 4.6 | 4.6 | 4.6 | 4.6 | 4.6 | 4.6 |
| Crosslinking Agent[g] | 0.15 | 0.15 | 0.15 | 0.1 | 0.1 | 0.1 | 0.1 | 0.1 | 0.1 | 0.1 | 0.1 | 0.1 |
| Gassing Agent[h] | 0.20 | 0.20 | 0.20 | 0.2 | 0.2 | 0.2 | 0.2 | 0.2 | 0.2 | 0.2 | 0.2 | 0.2 |
| Density (g/cc) | 1.06 | 1.06 | 1.04 | 1.07 | 1.11 | 1.03 | 1.08 | 1.03 | 1.05 | 1.09 | 1.06 | 1.08 |
| Detonation Results at 5° C.[i] (charge diameter and storage time indicated) | | | | | | | | | | | | |
| One Day | | | | | | | | | | | | |
| 75 mm | 3.3 | F | F | F | F | 4.0 | F | — | — | — | — | — |
| 100 mm | 3.7 | 2.2 | 2.8 | 3.5 | 4.0 | 4.1 | 2.5 | F | F | F | F | F |
| 125 mm | 4.1 | 3.5 | 3.1 | 4.0 | 4.1 | 4.5 | 3.7 | 3.6 | 3.0 | 3.5 | 3.6 | F |
| 150 mm | 4.2 | 4.0 | 4.0 | 4.1 | 4.4 | 4.7 | 4.2 | 4.2 | LOD | 3.9 | 3.8 | 4.0 |
| One Week | | | | | | | | | | | | |
| 75 mm | — | — | — | — | — | — | — | — | — | — | — | — |
| 100 mm | F | F | — | 3.4 | LOD | 4.0 | 3.3 | — | — | — | — | — |
| 125 mm | F | 3.3 | F | 3.6 | 4.0 | 4.1 | 3.8 | 3.4 | F | 3.6 | 3.6 | F |
| 150 mm | LOD | 3.5 | 3.6 | 3.7 | 4.4 | 4.2 | 4.2 | 3.7 | 2.8 | 3.9 | 3.4 | 3.8 |
| One Month | | | | | | | | | | | | |
| 75 mm | — | — | — | — | — | — | — | — | — | — | — | — |
| 100 mm | — | F | — | 2.9 | — | 3.5 | 3.3 | — | — | — | — | — |
| 125 mm | — | 3.5 | — | 3.6 | — | 3.6 | 4.1 | — | — | — | — | — |

TABLE -continued

| Composition (parts by Weight) | A | B | C | D | E | F | G | H | I | J | K | L |
|---|---|---|---|---|---|---|---|---|---|---|---|---|
| 150 mm | — | 3.9 | 3.3 | 4.0 | F | 4.2 | 4.2 | F | 2.6 | 3.4 | F | F |

KEY:
[a]nonylphenol ethoxylate, HLB = 17.8 ("Surfonic N-400")
[b]linear ethoxylated alcohol, $C_{11}$–$C_{15}$, HLB = 16.3 ("Tergitol 15-S-20")
[c]linear ethoxylated alcohol, $C_{11}$–$C_{15}$, HLB = 14.2 ("Tergitol 25-L-12")
[d]nonylphenol ethoxylate, HLB = 11.7 ("Tergitol NP-7")
[e]ethoxylated stearyl alcohol, HLB = 15.3 ("Lipal 20 SA")
[f]ethoxylated oleyl alcohol, HLB = 15.3 ("Lipal 20 OA")
[g]sodium dichromate solution
[h]sodium nitrite solution
[i]the decimal is detonation velocity in km/sec; F = failure; LOD = low order detonation

What is claimed is:

1. A stable aqueous blasting composition comprising inorganic oxidizer salt in particulate form, a solution of oxidizer salt in water forming a continuous aqueous phase, an immiscible liquid organic fuel finely dispersed throughout the aqueous phase, a thickener, a crystal habit modifier, and a nonionic surfactant having a hydrophilic character as shown by an HLB value above 11.0, selected from the group consisting of nonylphenol ethoxylates and linear ethoxylated alcohols having from about 11 to about 20 carbon atoms to retard desensitization of the composition that would otherwise occur due to the presence of the salt particles.

2. An aqueous blasting composition according to claim 1 wherein the nonionic surfactant is present in an amount of from a trace to about 1% or more.

3. An aqueous blasting composition according to claim 1 comprising inorganic oxidizer salt in an amount from about 50% to about 80% by weight based on the total composition, which salt is primarily ammonium nitrate of which at least about 10% is in solid, prill form, water from about 10% to about 35%, immiscible liquid organic fuel from about 1% to about 12%, crystal habit modifier from about 0.05% to about 3%, thickener from about 0.05% to about 1.5%, and nonionic surfactant from a trace to about 1% or more.

4. An aqueous blasting composition according to claim 4 wherein the immiscible liquid organic fuel is selected from the group consisting of mineral oil, waxes, paraffin oils, toluene, xylene, and mixtures of liquid hydrocarbons generally referred to as petroleum distillates such as gasoline, kerosene and diesel fuels; the crystal habit modifier is sodium methylnaphthalene sulfonate; and the nonionic surfactant is selected from the group consisting of nonylphenol ethoxylates and linear ethoxylated alcohols having from about 11 to about 16 carbon atoms.

5. An aqueous blasting composition according to claim 4 wherein the liquid organic fuel is No. 2 fuel oil.

6. A method of retarding desensitization with time of an aqueous blasting composition having an inorganic oxidizer salt in particulate form, an aqueous oxidizer salt solution as a continuous phase, an immiscible liquid organic fuel finely dispersed throughout such phase, a thickener, and a crystal habit modifier, which method includes the step of adding to the composition during its formulation at an elevated temperature, a nonionic surfactant having a hydrophilic character as shown by an HLB value above 11.0 selected from the group consisting of nonylphenol ethoxylates and linear ethoxylated alcohols having from about 11 to about 20 carbon atoms to retard desensitization of the composition with storage, which desensitization otherwise would occur due to the presence of the oxidizer salt particles.

7. A method according to claim 6 wherein the nonionic surfactant is present in an amount of from a trace to about 1% or more.

* * * * *